US007823367B2

(12) United States Patent
Boigues et al.

(10) Patent No.: US 7,823,367 B2
(45) Date of Patent: Nov. 2, 2010

(54) METHOD AND COMBINED MACHINE FOR CUTTING AND CLOSING BOXES WITH INSERTED VOID-FILLING BAGS

(75) Inventors: Michel Boigues, Nolay (FR); Joel Foulon, Combertault (FR)

(73) Assignee: Savoye, Dijon (FR)

( * ) Notice: Subject to any disclaimer, the term of this patent is extended or adjusted under 35 U.S.C. 154(b) by 98 days.

(21) Appl. No.: 11/987,258

(22) Filed: Nov. 28, 2007

(65) Prior Publication Data

US 2009/0031676 A1 Feb. 5, 2009

(30) Foreign Application Priority Data

Aug. 2, 2007 (FR) ..... 07 05666

(51) Int. Cl.
*B65B 43/08* (2006.01)

(52) U.S. Cl. ..... 53/456; 53/503; 53/504; 53/376.3

(58) Field of Classification Search ..... 53/52, 53/503, 504, 376.3, 266.1, 235, 237–240, 53/255, 257, 456
See application file for complete search history.

(56) References Cited

U.S. PATENT DOCUMENTS

| | | | | |
|---|---|---|---|---|
| 3,313,467 | A * | 4/1967 | Anderskow et al. | 229/101 |
| 3,598,303 | A * | 8/1971 | Folz | 229/101 |
| 4,085,564 | A * | 4/1978 | Focke | 53/461 |
| 4,449,349 | A * | 5/1984 | Roth | 53/66 |
| 5,016,753 | A * | 5/1991 | Henderson | 206/459.1 |
| 6,119,929 | A * | 9/2000 | Rose | 229/101 |
| 6,676,009 | B1 * | 1/2004 | Rose | 229/101 |
| 6,729,110 | B2 * | 5/2004 | Sperry et al. | 53/503 |
| 6,996,955 | B2 * | 2/2006 | White et al. | 53/495 |
| 7,337,595 | B2 * | 3/2008 | Harding | 53/504 |
| 2006/0090421 | A1 | 5/2006 | Sperry et al. | |
| 2008/0141625 | A1 * | 6/2008 | Bilkie | 53/396 |
| 2009/0173040 | A1 * | 7/2009 | Carlson et al. | 53/250 |

FOREIGN PATENT DOCUMENTS

| | | | |
|---|---|---|---|
| FR | 2 385 606 | A1 | 10/1978 |
| FR | 2 580 597 | A1 | 10/1986 |
| FR | 2 606 367 | A1 | 5/1988 |
| FR | 2 612 885 | A1 | 9/1988 |
| FR | 2 710 580 | A1 | 4/1995 |
| GB | 2 178 694 | A | 2/1987 |
| WO | WO 2005/077784 | A1 | 8/2005 |
| WO | WO 2007022480 | A1 * | 2/2007 |

* cited by examiner

*Primary Examiner*—Christopher Harmon
(74) *Attorney, Agent, or Firm*—Oliff & Berridge, PLC

(57) ABSTRACT

The invention relates to the making of boxes of a variable volume adapted in each case to the height of the packed products, including cutting the box along its vertical edges and forming fold lines at a suitable height around the sides of the box to define top flaps; and then folding these flaps onto the contents of the prefilled box. At least one inflated or inflatable void-filling bag is inserted into the box, around and/or above the packed products, after the fold lines have been formed, and before the flaps are folded onto the contents of the box. The invention also provides a combined machine that cuts, marks, prepares and inserts void-filling bags, and closes boxes.

Applicable to order filling.

3 Claims, 5 Drawing Sheets

METHOD AND COMBINED MACHINE FOR CUTTING AND CLOSING BOXES WITH INSERTED VOID-FILLING BAGS

The present invention relates in the general way to the making and filling of usually cardboard packs, referred to here more simply as "boxes", the height and volume of which are adapted to the height and volume of whatever products are filling the box. The invention thus relates more especially to order filling and the shipping of products varying in nature and quantity in such a way that the products brought together in one box may occupy different volumes and heights.

In this field of application, it is already prior art to use cardboard boxes whose dimensional characteristics are initially identical, which are then adapted to each particular use, generally by reducing the height of each box to adapt it to the height of the products placed in that box.

One approach, described in patent FR 2 710 580 in the applicants' name, is to cut a cardboard box before filling it, in order to eliminate the unwanted surplus cardboard to suit the greater or lesser height of the contents of the box. This results in a greater or lesser amount of waste cardboard which has to be taken away.

Other known approaches reduce the volume and in particular the height of a cardboard box to adapt it to the height of the packed products without producing waste which then has to be removed.

In this category, one particular solution is to provide several parallel fold lines close together, on the four sides of the box. Depending on the height occupied in each case by the products placed on the bottom of the box, the operator selects on each side of this box the fold line along which a top flap will be formed and folded down onto the packed products (see for example patent FR 2 612 885). This approach requires pre-forming a reasonable number of fold lines round the four sides of the box, even though only one of them will actually be used, so the solution is relatively complicated and expensive when considering its intended purpose. Even then, the height adaptation of each box is only approximate because it can only be done in a discontinuous manner by selecting a "pitch" equal to the spacing between two consecutive fold lines.

An alternative solution, which avoids these latter drawbacks, is to use a box in which those parts which are intended to become the top flaps are not defined by preformed fold lines. For each use, and on the basis of the height of the products to be packed, a fold line is formed on each side of the box at the appropriate height. The flap defined by this line is then folded down on top of the contents of the filled box (see for example patent FR 2 606 367).

This latter approach involves cutting each box down its four vertical edges, beginning at its top and continuing for part of its height equal to the difference between the initial height of the box and the height of the products with which this box is filled, in order to make individual flaps which can then be folded down immediately above said products.

Clearly, all these known approaches do allow the height of each box to be at least approximately adapted to the height of the products with which they are filled, or at least to the height of the tallest product. Nevertheless, none of these solutions is in itself really able to accommodate itself to the shape, distribution and volume of the products packed in a box. Given the heterogeneous nature of the products, even if the height of the box is right there still may be large empty spaces left between the products or above certain products. No void-filling or securing is therefore provided for certain products, which may therefore shift, collide and even be damaged during handling and shipping of the box, especially if the products are fragile.

It would be seen that the problem described above can occur particularly where boxes are filled to a very low level, lower than the maximum cutting reach of the machine used to form the flaps. It should be appreciated here that the maximum cutting reach is equal to one half of the width of the box and it is not usually desirable to allow the flaps created to overlap where they meet along the center of the box. In an extreme case such as this, the final height of the box is left greater than the height of the packed products.

It is true that the prior art already includes systems for preventing movement of products inside cardboard boxes by using objects to fill the voids left around and above the packed products. Void fill may in particular take the form of bags or pillows inflated with air—see for example patents FR 2 580 597 and FR 2 385 606, and patent applications WO 2005/077784 and US 2006/0090421.

These void filling systems are not yet satisfactory, either technically or in terms of cost, particularly in the context of order filling: if the products filling a box of a given height occupy only part of the height or part of the volume of the box, highly inflated void-filling bags, or many such bags have to be inserted and laid in successive layers. The latter approaches give poor results in terms of preventing products moving about and adapting to their shapes, and yet are expensive, and can additionally create problems when it comes to closing the boxes.

It is an object of the present invention to solve all of the problems described above by providing an improved system that combines the advantages of a lower box with a means for preventing movement of the products packed in the box, while at the same time avoiding their disadvantages.

To this end, the subject of the invention is a variable volume adapted in each case to the height of the packed products, the method involving cutting the box along its vertical edges, beginning at its top and continuing for part of its height; forming fold lines at a suitable height around the sides of the box to define top flaps; and then folding these flaps onto the contents of the prefilled box, this method being essentially noteworthy in that at least one inflated or inflatable void-filling bag is inserted into the box, around and/or above the packed products, after the fold lines defining the top flaps have been formed, and before these flaps are folded onto the contents of the box.

In a preferred embodiment of the method of the invention, after the box has been filled, the height of the packed products and the unoccupied volume around and above these products are detected automatically, and the result of this detection is used to determine, in a combined manner, the height to which the corners of the box are to be cut, the position of the fold lines on the sides of the box, and the volume or quantity of inflated or inflatable bags to be inserted in order to prevent the products moving about inside the box.

In this way the method of the invention combines, in an advantageous manner, the reduction of the height of the box to adapt it to the height of the contents, and the filling of the residual empty spaces (already minimized) around and above the packed products, by means of one or more inflated or inflatable void-filling bags, the volume or number of which are therefore also minimized. In particular, the volume of the void-filling bag deposited in the box is such that the top of the bag coincides approximately with the height marked on the sides for the purpose of their folding, while nonetheless allowing an initially slightly greater height to the top of the bag, so that when the box is closed the bag is slightly compressed and holds the packed products securely in position.

As will be seen from the above, the same "vision" system, which may take the form of a number of depth-measuring cells analyzing the filling of the box in different areas, or a video camera to image analysis means, serves both to determine the maximum height of the products filling the box for the purpose of cutting the corners and marking and then folding the flaps at the appropriate height, and to calculate, as a function of the distribution of the products and their measured heights, how much volume is to be filled with the void-filling bag or bags. In a variant, the "vision" system is replaced with one or more mechanical contact sensors, which perform the same function.

The same "vision" or contact-sensing means thus enable the height of the box to be appropriately reduced and the volume or number of void-filling bags to be adjusted in the light of the height reduction resulting from the cuts and the height of the fold lines; for which purpose the system looks not only at the measured height of the tallest packed product but also at the minimum and/or maximum cutting reach of the machine used. The method may therefore clearly be described as combined and integrated, closely linking together the reduction of the height of the box and the insertion of void-filling bags inside the box.

In the context of such a combination, the reader will also observe the advantage of placing the void-filling bag or bags in each box immediately prior to folding the flaps down on top of the contents of the box, and therefore also on top of the void-filling bag or bags.

Such a procedure restricts any undesirable movement of the void-filling bag or bags within the box, and prevents the bag or bags escaping from the box before it is finally closed. This would not be the case if two conventional machines were used, namely one machine to make and weigh the void-filling bags, and a second machine to form the flaps and fold them because in such a case the void-filling bags could jump out of the boxes while the boxes were being transferred from one machine to the other.

In one particular embodiment of the method of the invention, the or each void-filling bag is inserted into the box in the uninflated state, and this bag is inflated inside the box. This approach makes it possible to continue to use simple means for detecting the height of the products placed in the box, and makes it unnecessary to calculate the volume to be filled around and above the products, since the bag is necessarily inflated to the limits of the available volume. The void-filling bag may in this case have a variable length that is a function of the difference in height between the top of the box and the tallest product, especially if bag inflation is done at a constant level above the box; more simply, the bag may have a constant length adapted to the dimensions of the box, especially if bag inflation is done at a variable level within the box.

In another embodiment of the method of the invention, the or each void-filling bag is inflated before being inserted into the box, the degree of inflation of the void-filling bag and/or the number of void-filling bags introduced being determined for each box as a function of the calculation of the volume to be filled.

In a variant of the above embodiment, each void-filling bag is first inflated to a predefined maximum degree of inflation independently of the volume to be filled, inserted into the box, partially deflated, and finally sealed, so as to adapt to the volume to be filled in each case. In particular, each void-filling bag, pre-inflated to the maximum extent is pierced once inside the box, to evacuate the excess air, after which the void-filling bag is sealed in order definitively to enclose the quantity of air held in this bag.

Such a procedure, in which the void-filling bag adapts itself directly to the volume to be filled in each case, can be advantageous in the sense that it circumvents the uncertainties of volume calculations which can result in ineffective securing of the products in the box.

The invention also relates to a combined machine for carrying out the method defined above.

This machine, in which the pre-filled boxes advance along a conveyor, comprises in a known manner the following items encountered successively along the conveyor: a station for detecting the height of the products in each box, a station for cutting the boxes along their vertical edges to a certain height, a station for marking the sides of the boxes to form the fold lines, a station for folding the flaps down onto the contents of the box, and a station for placing the closing lids on top of the boxes, according to the invention, the machine also comprises, between the side marking station and the flap folding station, a station for preparing inflated or inflatable void-filling bags and inserting them into the boxes.

The void-filling bags are thus inserted by a supplementary machine station. This additional station may in particular comprise means for unwinding a continuous film or sheath material, in which the void-filling bags are formed and separated by sealing and cutting them, means for inflating and closing each bag, and means for placing each bag in a box. These latter means advantageously comprise a rigid plate designed to be lowered into each box, approximately level with the fold lines formed in each case, so that the bags are inflated to a volume corresponding to the volume to be filled and in which the flaps will be once folded; such a solution is particularly applicable where the void-filling bags are inflated only after being placed inside the boxes.

The void-filling bag inflating means and the means for closing the void-filling bags, notably by sealing them, may be maintained at a constant height above the tops of the boxes.

In accordance with another possibility, the void-filling bag inflating means and the means for closing, as by sealing, the inflated void-filling bags are situated at a variable height and can be introduced into the boxes; in this latter case, said means may be connected to the bag placing means.

However, the invention will be understood more clearly from the following description, which refers to the attached schematic drawing illustrating, by way of examples, certain embodiments of this method for cutting and closing boxes with insertion of void-filling bags and showing the combined machine employing this method:

Figure 1:
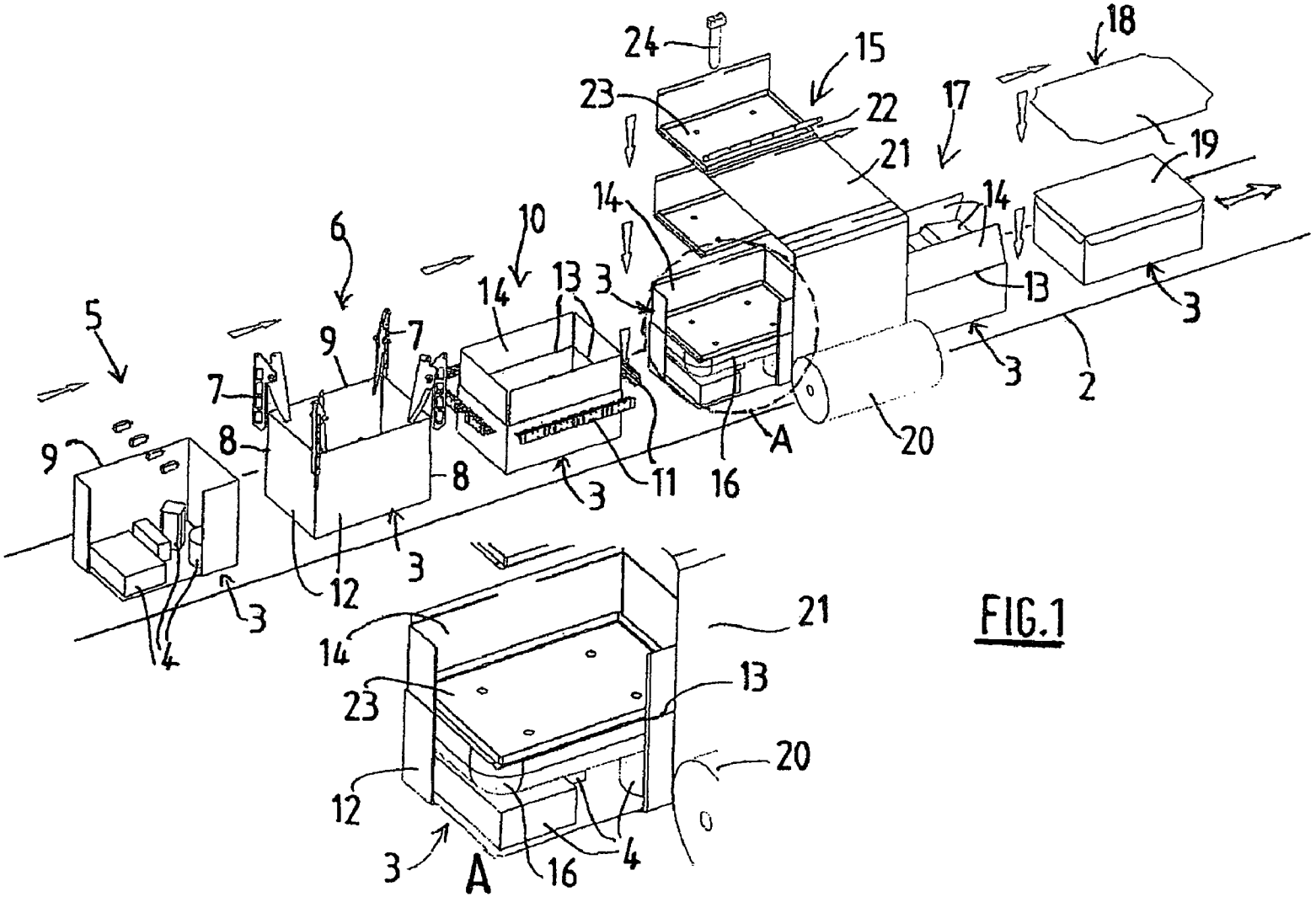
FIG. 1 is a perspective view showing a first embodiment of the method of the invention.

FIG. 1 shows in schematic form the successive stations of a machine. These stations are arranged in line along a horizontal conveyor 2, such as a bar, belt or band type conveyor carrying cardboard boxes 3 filled with products 4 of varying heights.

A first station 5 at which the boxes 3 arrive as they enter the machine comprises optical "vision" means, or alternatively one or more mechanical contact probes to detect the height of the products 4 inside each box 3.

A second station 6 has cutting tools 7 which cut the boxes 3 down their four vertical edges 8. More specifically, the tools 7 make vertical cuts along the edges 8 of each box 3 to a certain height, from the top 9 of the box 3, the cut stopping above the tallest product 4.

A third station 10 uses special tools 11 to horizontally mark the four sides 12 of the boxes 3 for forming into fold lines 13. More specifically, the marks are made on each box 3 level with the lower end of the slits made in the previous station along the vertical edges 8 of the box 3.

In this way, the operations of cutting and marking, performed in stations 6 and 10, respectively, result in the defining of four top flaps 14 of variable width depending on the height of the products 4 packed in each box 3.

A fourth station 15, of which a detail A is also shown in an enlarged view, follows the marking station 10 and forms a station for the preparation and insertion of inflated or inflatable void-filling bags 16, as described in detail later.

After station 15, a fifth station 17 folds the flaps 14 along the lines 13, down onto the contents of each box 3, that is over the products 4 packed in the box and over the void-filling bag or bags 16 placed in this box 3 in the previous station to stop said products 4 moving about.

Lastly, a sixth and final station 18 places a cardboard lid 19 on top of each box 3, that is on top of the folded flaps 14, to close this box 3. A storage magazine, not shown, for lids is connected to the side of this station 18. The filled boxes 3, closed at station 18, are finally discharged from the downstream end of the conveyor 2.

The station 15 for preparing and inserting void-filling bags 16 comprises a lateral unwinder for a reel 20 of continuous material 21 in the film or sheath form. This station 15 comprises means for pulling and guiding the material 21 and positioning it over each box 3 arriving at said station. At the top of this station 15, cutting means 22 cut the film or sheath material 21 to separate off the material which will form a single void-filling bag.

Figure 3:
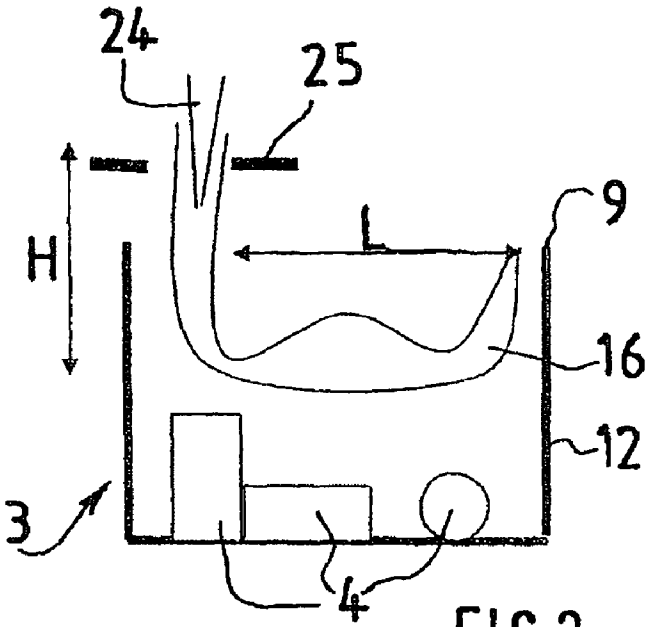
FIG. 3 is a diagram showing the operations of inflating and sealing a void-filling bag, in the case of the embodiment shown in FIG. 1.

With the cutting means 22 there are also bag inserting means in the form of a rigid plate 23 designed to be lowered into each box 3, and inflating means in the form of a nozzle 24 and sealing means in the form of a pair of sealing jaws 25—see FIG. 3. In the present case, the inflating nozzle 24 and the sealing jaws 25 are maintained at a constant height, above the top 9 of the boxes 3.

In this way, each void-filling bag 16, detached from the film or sheath of material 21 by the cutting means 22, passes under the rigid plate 23 which is lowered into the box 3 and positioned approximately level with the marking made in the third station 10 corresponding to the fold lines 13 of the flaps 14, the flaps 14 at present still being vertical. The bag 16 is then inflated with air through the nozzle 24 before being sealed off by the jaws 25. The bag 16 is thus inflated to the maximum allowed by the position of the rigid plate 23 and now fills all the free space between the products 4 and the rigid plate 23.

As FIG. 3 makes clear, the fact that the inflating nozzle 24 and the sealing jaws 25 are at a constant height above the tops 9 of the boxes 3, means that the void-filling bag 16 here possesses a variable length "L+H", this being the portion of fixed horizontal length of the bag 16 inside the box 3, and H being the variable difference of height between the tops of the products 4 and the constant level of the nozzle 24 and of the jaws 25.

Figure 2:
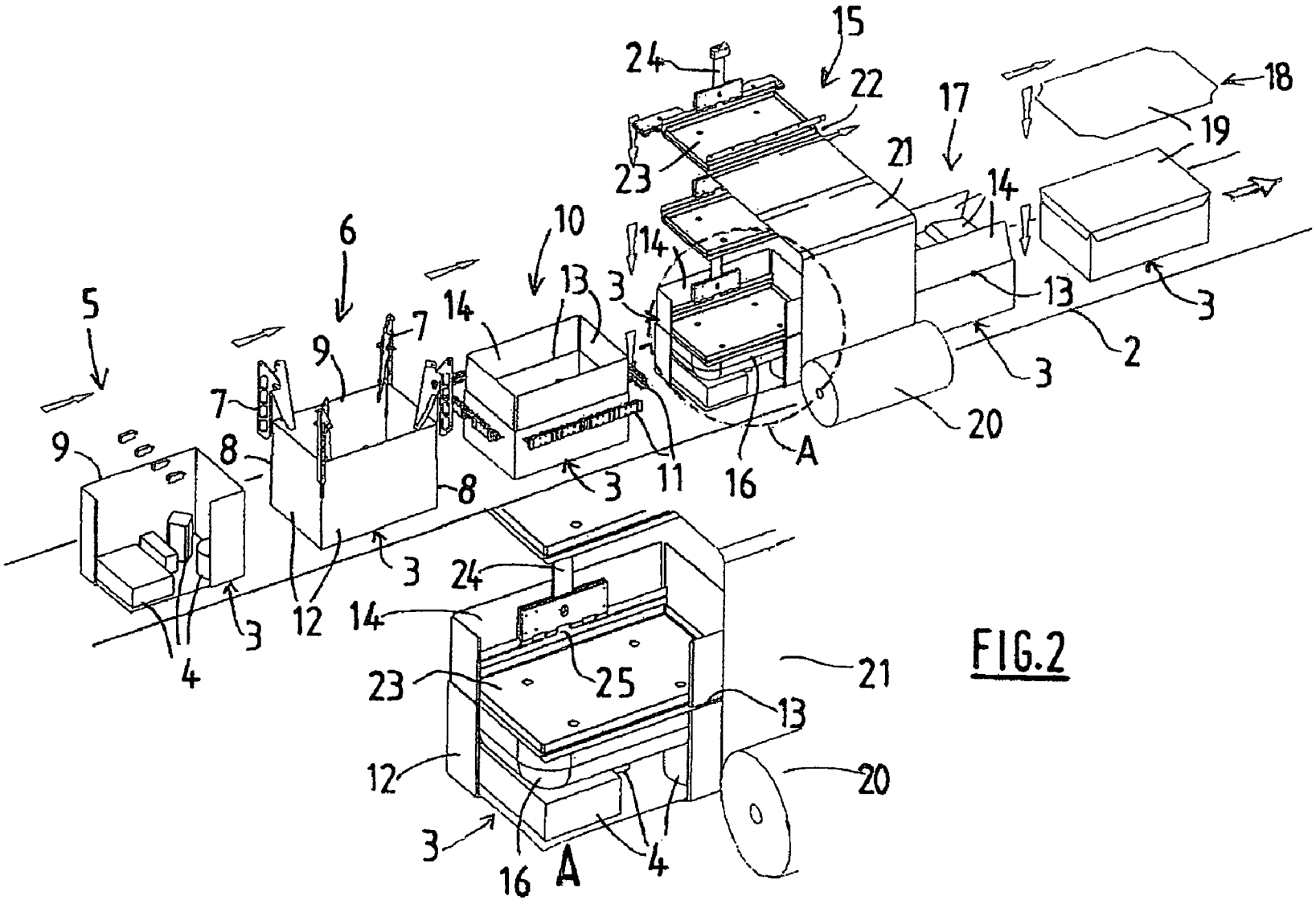
FIG. 2 is a perspective view similar to FIG. 1, showing a variant of this first embodiment.
Figure 4:
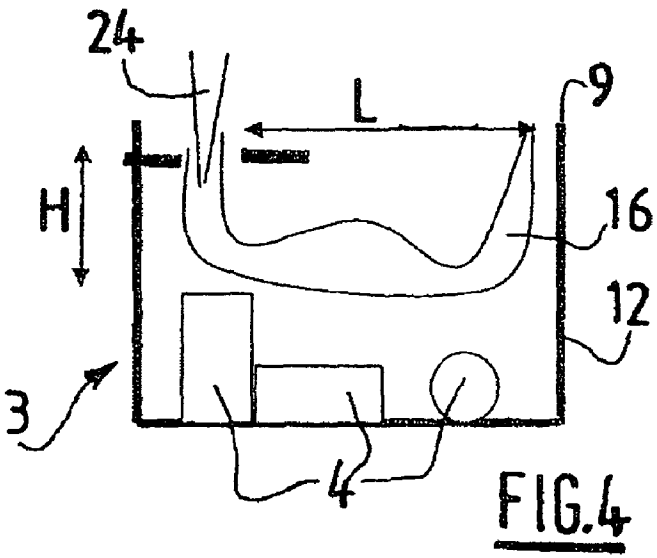
FIG. 4 is a diagram similar to the preceding diagram that shows the operations of inflating and sealing a void-filling bag in the case of the FIG. 2 variant.

FIGS. 2 and 4, in which parts corresponding to those described earlier are given the same references, relate to a variant in which the inflating means, namely the nozzle 24, and the welding jaws 25, are attached to the rigid plate 23 and can thus be lowered with this plate 23 into each box 3. As FIG. 4 shows, the void-filling bag 16 here possesses a constant length "L+H", L being the portion of fixed horizontal length of the bag 16 inside the box 3, and H being the height difference (also fixed) between the tops of the products 4 and the corresponding level to which the nozzle 24 and jaws 25 are brought.

This variant, in which the void-filling bag 16 inflating and sealing means are carried "on board" the bag inserting mechanism, will be seen to be particularly suitable where the detached bags 16 are already partly welded, before being inflated, with only a relatively short section left unsealed along one side when the bag is being prepared. The sealing means such as the sealing jaws 25 are thus shorter and can easily be mounted on the inserting mechanism and introduced into the boxes 3.

Figure 5:
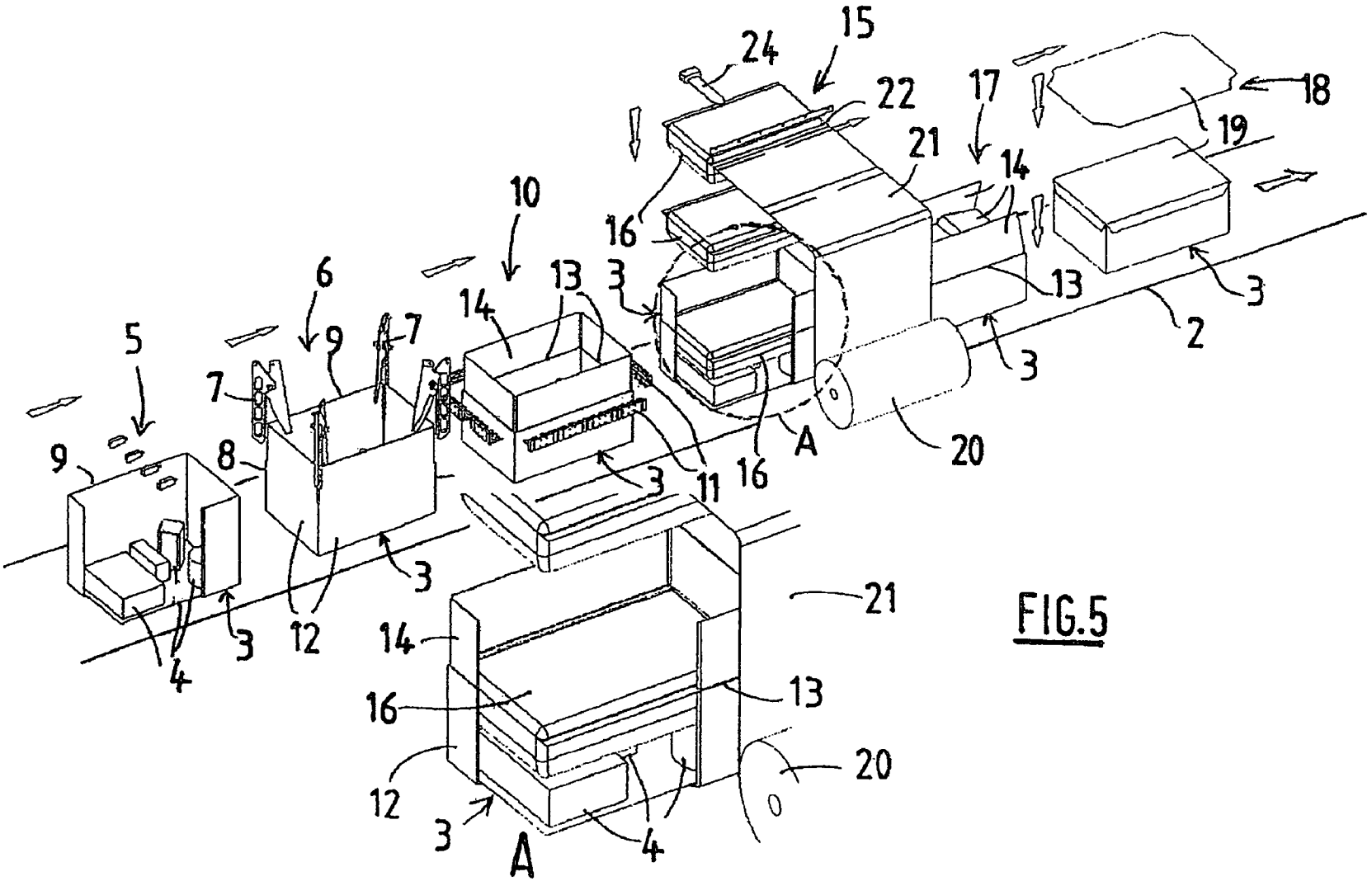
FIG. 5 is a perspective view similar to FIGS. 1 and 2, showing a second embodiment of the method of the invention.

FIG. 5 illustrates another embodiment of the method of the invention, in which the void-filling bags 16 are inflated definitively before being inserted into the boxes 3. At the void-filling bag 16 preparation and insertion station 15, each bag 16 is detached by the cutting means 22 and the bag 16 is then filled with air through a nozzle, to a precise volume calculated from the data of the "vision" means located at the first station 5. This void-filling bag 16 is thus inflated to its correct value, corresponding to the volume of free space around and above the products 4. The inflated void-filling bag 16 is then lowered and placed in the corresponding box 3, on top of the products 4, as the enlarged detail A of FIG. 5 illustrates in particular.

Figure 6:
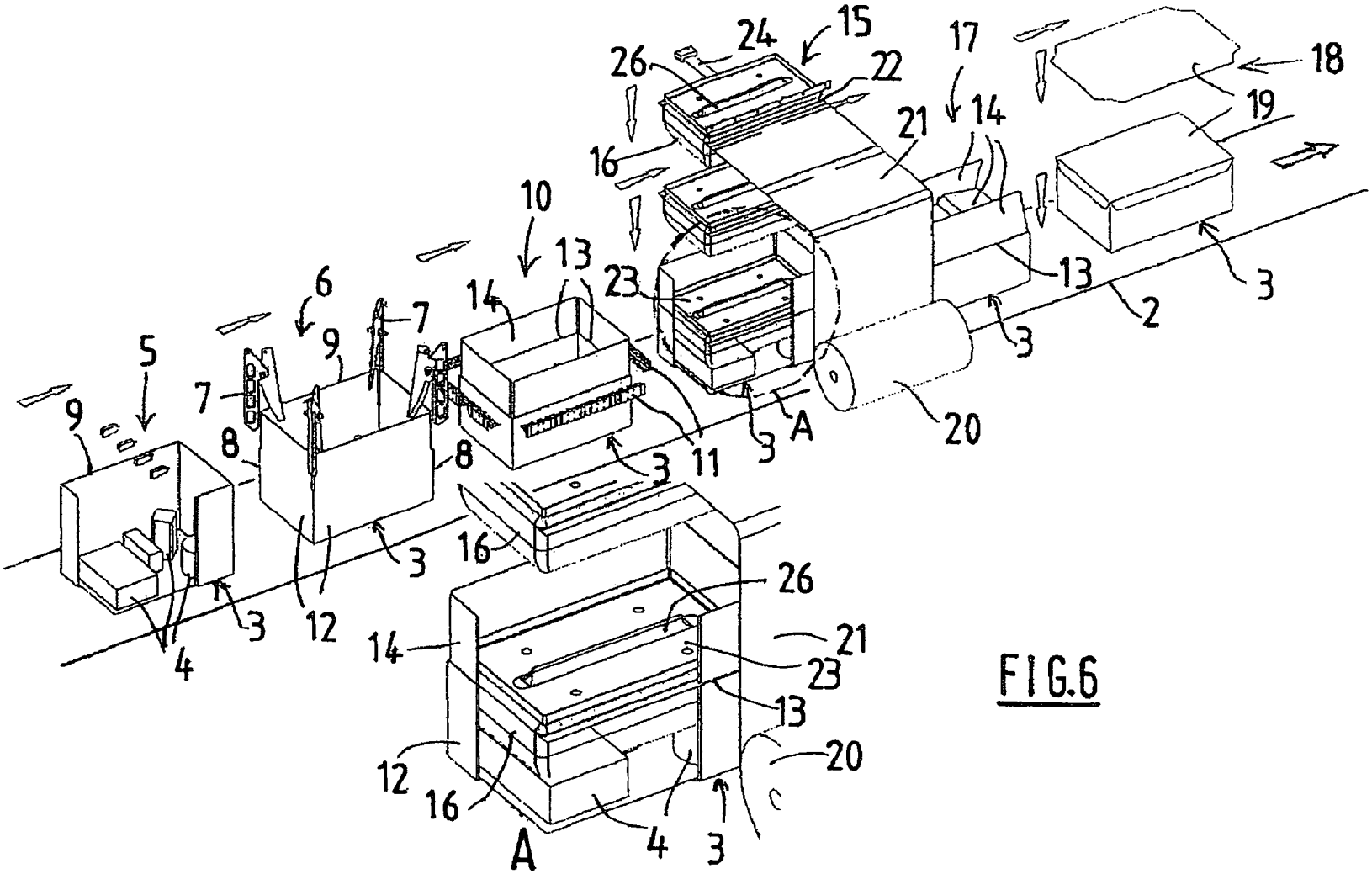
FIG. 6 is a perspective view similar to the preceding views, showing a third embodiment of this method.

FIG. 6 further illustrates another embodiment of the method of the invention, in which the void-filling bags 16 are inflated to a predefined maximum degree prior to being inserted into the boxes 3. At the void-filling bag 16 preparation and insertion station 15, each bag 16 is therefore detached by the cutting means 22. The bag 16 is then inflated with air to its maximum through a nozzle. The inflated void-filling bag 16 is then lowered and inserted into the corresponding box 3, on top of the products 4, as the enlarged detail A of FIG. 6 shows in particular. During this operation, the bag 16 in question may be pinched at its center by a tab 26 formed on its upper face along a central line.

Once inserted, the void-filling bag 16 is pierced at its upper tab 26, while the rigid plate 23 is applied to this bag 16 and positioned level with the marks formed earlier on the sides 12 of the box 3. The excess air then escapes from the bag 16 and the bag is then sealed again, that is reclosed, along the tab 26. By this means the degree of inflation of each bag 16 is adapted in each case to the volume left unoccupied inside the box 3 around and above the products 4, thereby obviating the need to perform measurements or calculations of the available volume beforehand.

Other procedures could also be devised. For example, a prepared but uninflated void-filling bag could be pinched in the center and inflated only after being inserted in a box. It would then however be helpful to provide, at the void-filling bag preparing and inserting station, a device for separating the two main faces, initially stuck together, of each bag, by mechanical means or suckers or other means.

Whether the void-filling bags 16 are inflated prior to their insertion, or inflated only after being placed in the boxes 3, the method and machine of the invention in all cases optimize the packing of products 4 of different heights by adapting and pre-minimizing the volume and in particular the height of each box 3, and by adapting and also minimizing the volume of the bag 16 necessary for filling the voids around and above the products 4.

It will be self-evident that the invention is not limited to only those embodiments described above by way of example. On the contrary it encompasses all variants that employ the same principle. As an example, it would not be a departure from the scope of the invention to insert into a box two or more inflated or inflatable void-filling bags instead of one bag. Similarly, the method of the invention is applicable not only to marking each side of the boxes with a fold line whose level corresponds very precisely to the height of the products placed in the boxes, but also to following predefined or "indexed" heights approximately equal to the height of the products, which would permit automatic palletizing of the boxes by making the boxes of each layer all the same height.

The invention claimed is:

1. A method for making a cardboard pack of the box type, of a variable volume adapted in each case to a height of packed products, the method comprising:

cutting the box along its vertical edges, beginning at its top and continuing for part of its height;

forming fold lines at a suitable height around the sides of the box to define top flaps;

folding the flaps onto the contents of the prefilled box; in which placing at least one inflated or inflatable void-filling bag into the box, around and/or above the packed products, after the fold lines defining the top flaps have been formed, and before the top flaps are folded onto the contents of the box; and adjusting the degree of inflation of the at least one void-filling bag to the free volume existing around and/or above the packed products, after inserting the at least one void-filling bag into the box but before the box is closed by folding the flaps, the free volume being bounded by the interior dimensions of the box in a closed position, wherein each of the at least one void-filling bags is first inflated to a predefined maximum degree of inflation independently of the volume to be filled, inserted into the box, pierced once to evacuate the excess air, and finally sealed, so as to adapt to the volume to be filled in each case and definitively enclose the quantity of air held in the bag.

2. The method as claimed in claim 1, in which, after the box has been filled, the height of the packed products and the unoccupied volume around and above these products are detected automatically, and the result of this detection is used to determine, in a combined manner, the height to which the corners of the box are to be cut, the position of the fold lines on the sides of the box, and the volume or quantity of the at least one inflated or inflatable bag to be inserted in order to prevent the products moving about inside the box.

3. The method as claimed in claim 1, in which the volume of the at least one void-filling bag deposited in the box is such that the top of the bag coincides approximately with the height marked on the sides for the purpose of their folding, while nonetheless allowing an initially slightly greater height to the top of the at least one bag, so that when the box is closed the bag is slightly compressed and holds the packed products securely in position.

* * * * *